US007766682B1

(12) United States Patent
Larkin

(10) Patent No.: US 7,766,682 B1
(45) Date of Patent: Aug. 3, 2010

(54) FLEXIBLE CONNECTOR INTERFACE RIB WITH SAW TOOTH CROSS SECTION

(76) Inventor: Kevin B. Larkin, 1140 Porque La., Pebble Beach, CA (US) 93953

( * ) Notice: Subject to any disclaimer, the term of this patent is extended or adjusted under 35 U.S.C. 154(b) by 98 days.

(21) Appl. No.: 12/240,177

(22) Filed: Sep. 29, 2008

(51) Int. Cl.
*H01R 13/52* (2006.01)

(52) U.S. Cl. ..... 439/281

(58) Field of Classification Search ..... 439/557, 439/357, 358, 352, 936, 587, 281, 282
See application file for complete search history.

(56) References Cited

U.S. PATENT DOCUMENTS 4,312,553 A * 1/1982 Lyckesjo ..... 439/281
5,951,337 A * 9/1999 Brake ..... 439/825
6,290,525 B1 9/2001 Jacobi
7,232,337 B1 * 6/2007 Pepe et al. ..... 439/557
7,306,469 B1 12/2007 Slautterback
2004/0242063 A1 * 12/2004 Miyamoto ..... 439/557

* cited by examiner

*Primary Examiner*—Neil Abrams
*Assistant Examiner*—Phuong Nguyen
(74) *Attorney, Agent, or Firm*—Johannes Schneeberger

(57) ABSTRACT

A saw tooth shaped flexible rib in between a connector interface provides asymmetric sliding resistance and a one sided sealing effect. The asymmetric sliding resistance provides for low frictional engaging resistance and for a high disengaging resistance of the connector interface. The one sided sealing effect provides in conjunction with an interface cavity for back flow resistance into the cavity during disengagement movement in the interface and for a vacuum effect that assists in opposing the disengagement movement. The flexible rib may be monolithically fabricated together with the entire housing of the respective connector.

19 Claims, 4 Drawing Sheets

FLEXIBLE CONNECTOR INTERFACE RIB WITH SAW TOOTH CROSS SECTION

FIELD OF INVENTION

The present invention relates to flexible ribs in the connector interface of connectors that provide asymmetric friction resistance and one directional sealing.

BACKGROUND OF INVENTION

Signal transmitting connectors such as peripheral electrical connectors commonly employ an overall housing that is monolithically encompassing the connector's terminal(s) while providing a strain relief at the same time. Such overall housing is preferably made of plastic that is sufficiently soft to provide sufficient impact resistance and flexural elasticity for the integrated strain relief as is well known in the art. In the prior art, the electric terminal(s) have been also surrounded by a surrounding tubular protrusion that is intended to fit snugly into a mating female cavity of another connector or connector site. In that way, mechanical loads are transferred from the connector housing directly onto the other connector housing and the electrical terminal(s) remain substantially stress free. Unfortunately, the relatively soft nature of the tubular protrusion makes it difficult to provide an arresting feature that assists in keeping the connector connected against eventual pulling forces, vibrations and such. Therefore, there exists a need for an arresting feature for a tubular connector protrusion that can be fabricated from soft plastic material and that provides for an increased resistance against unplugging while keeping the required force for plugging in of the connector to a minimum. The present invention addresses this need.

SUMMARY

A surrounding tubular protrusion at a connector interface features continuous circumferential ribs that extend radially outward from the outside mating face of the surrounding tubular protrusion. The continuous circumferential ribs are of a softness that provides for sufficient deflection when the tubular protrusion is inserted into a mating female cavity. As two connectors are connected, the ribs are radially compressed and provide on one hand a snug connection such that a substantially air tight interface cavity is created inside the female cavity. The flexible ribs have a saw tooth like cross section that assists on one hand in a one directional venting of air out of the interface cavity during insertion while blocking air to flow back into the interface cavity while the connector is pulled out. This creates an ambient air pressure assisted arresting effect. On the other hand, the saw tooth like cross section provides for a low friction resistance during insertion and a high frictional resistance against pull out of the connector. The flexible ribs may be monolithically fabricated together with the surrounding tubular protrusion and the remainder of the housing.

DETAILED DESCRIPTION

Figure 1:
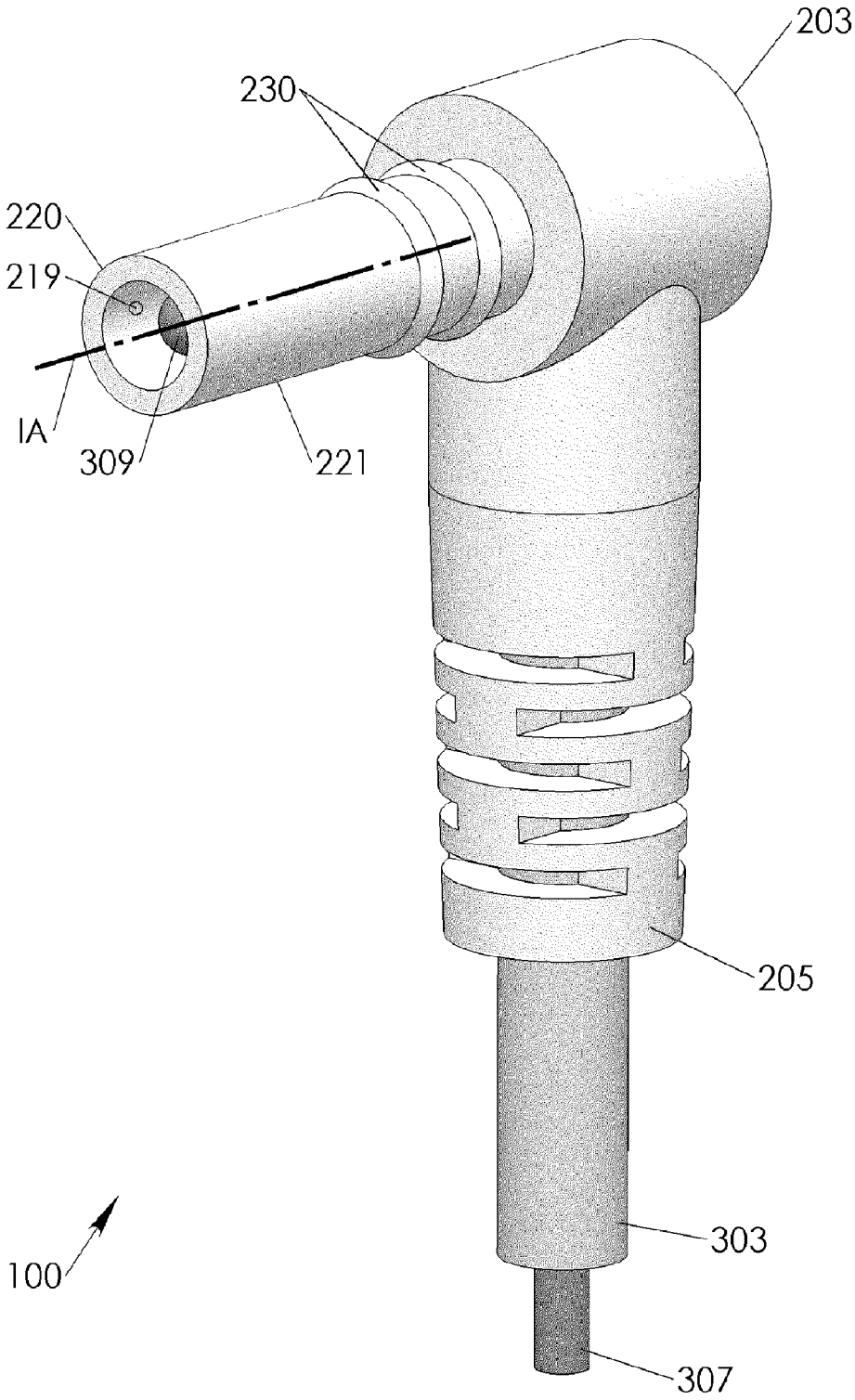
FIG. 1 is a perspective view of a connector according to a preferred embodiment of the invention.
Figure 2:
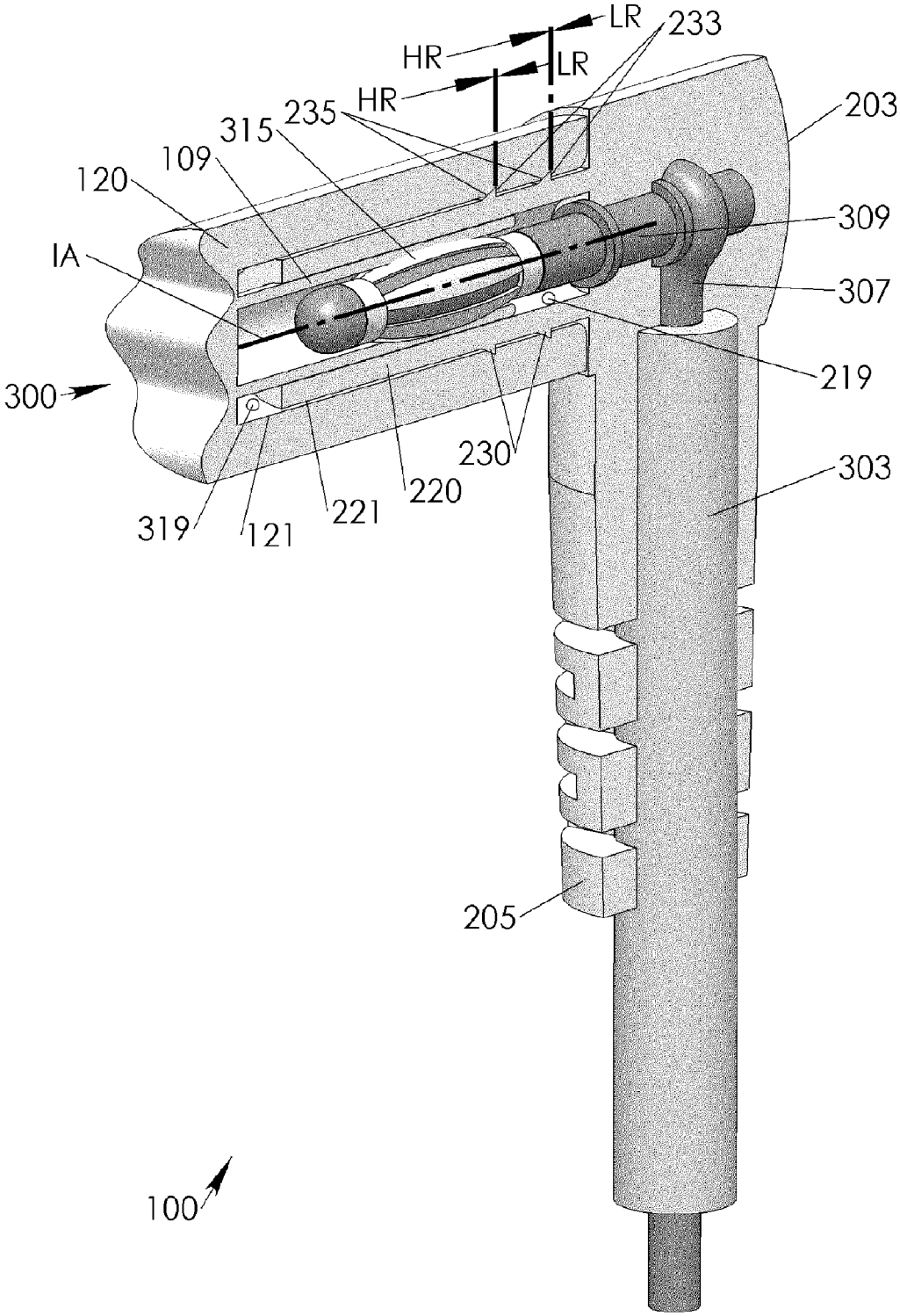
FIG. 2 is the perspective view with a housing of the connector of FIG. 1 and a connector interface being displayed in cut view.
Figure 3:
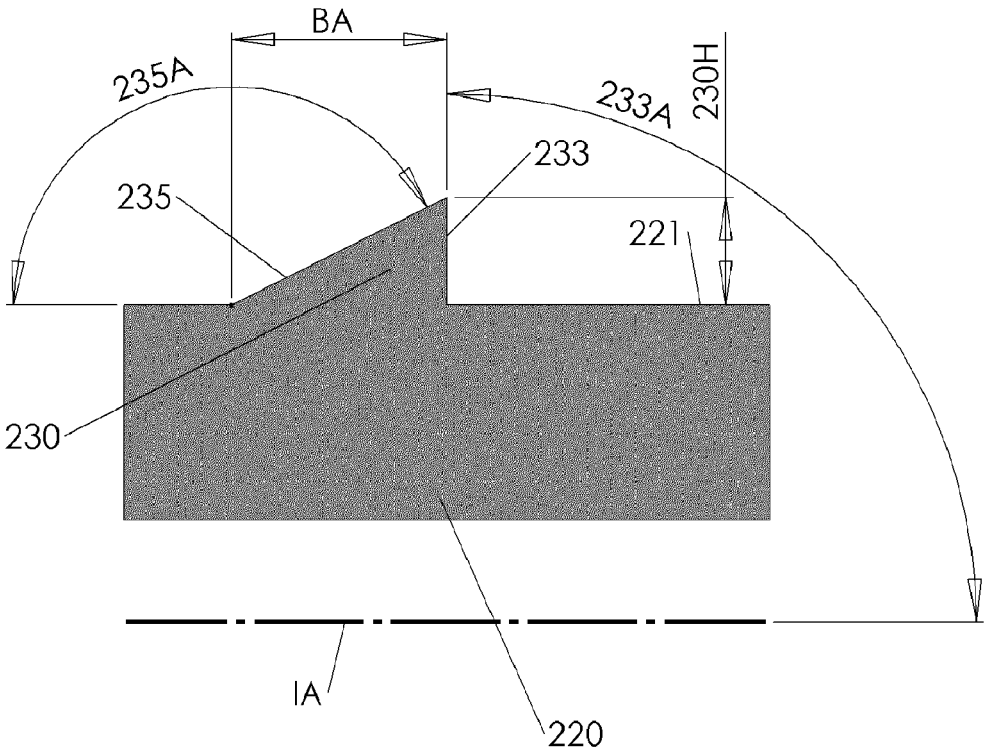
FIG. 3 is a detail section view of a flexible rib as in FIGS. 1, 2.

Referring to FIGS. 1-4, a connector 100 has an insertion axis IA along which it may be connector to another mating connector 300 a portion of which is depicted in FIG. 2. The connector 100 has a mating face 221 with one or more flexible ribs 230 that extend above the mating face 221 and propagate along the mating face 221 at least in a substantial angle with respect to the insertion axis IA. Preferably the flexible ribs 230 are perpendicular with respect to the insertion axis IA and circumferentially continuous on the outward mating face 221.

The flexible ribs 230 have a saw tooth cross section including a steep flank 233 and a shallow flank 235. The shallow flank 233 is in a first flank angle 235A with respect to the insertion axis IA and the steep flank 235 is in a second flank angle 233A with respect to the insertion axis IA. While the connector 100 is operationally connected, a connector interface may be defined with an opposing inward mating face 121 of the other mating connector 300.

Figure 4:
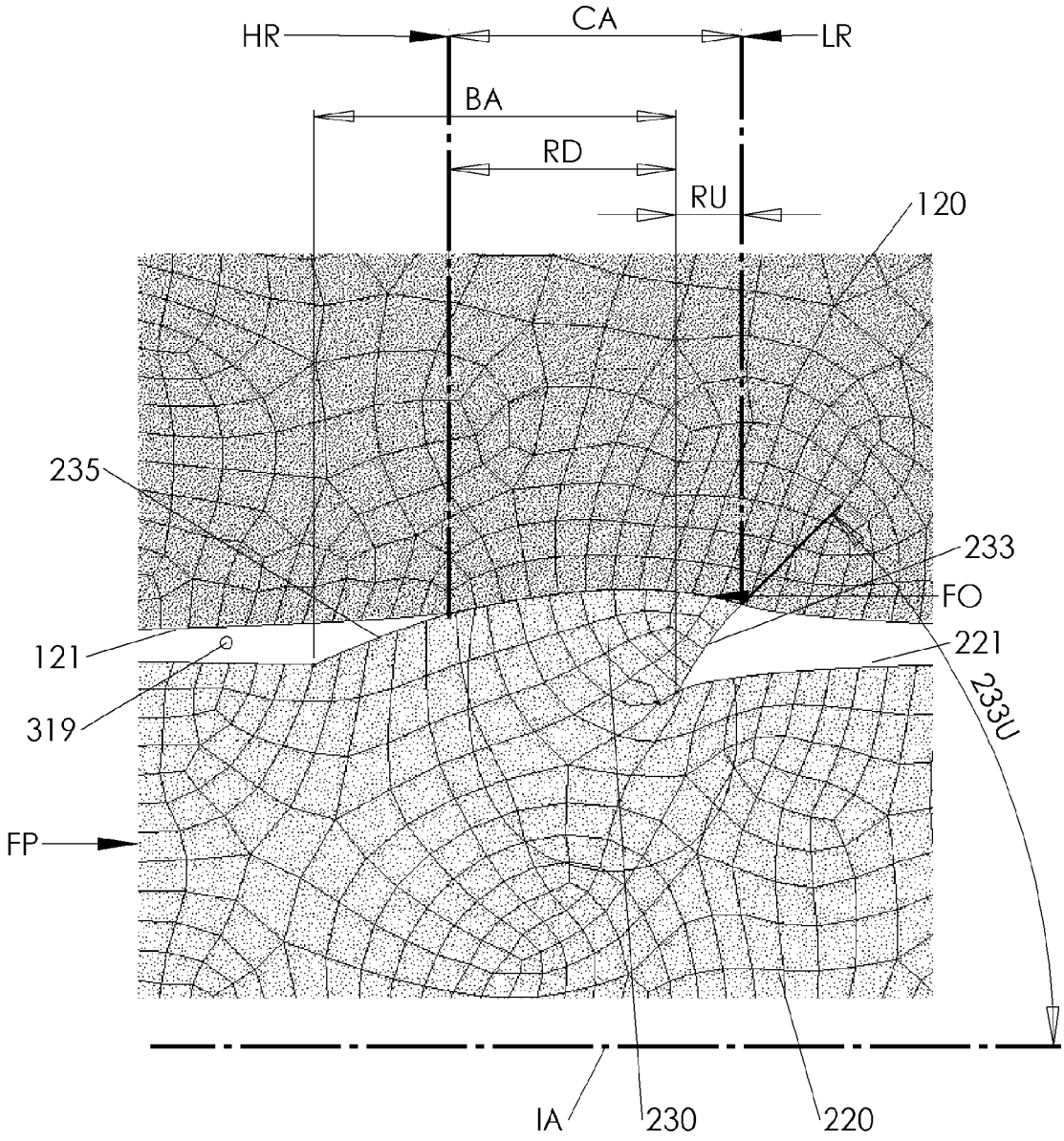
FIG. 4 is a finite displacement analysis computed with commercially available FEA software of a detail of the connection interface of FIG. 2, including the flexible rib of FIG. 3 under operational radial compression.

While the two connectors 100, 300 are connected and the connector interface 121, 221, 230 engaged, the other opposing mating face 121 may induce a substantially radial compression on the flexible ribs 230 as is representatively depicted in FIG. 4. Due to the saw tooth cross section, the flexible ribs 230 provide an asymmetric friction resistance against the opposing mating face 121 along the insertion axis IA. Also during operational radial compression, a substantial portion RD of the radial contact pressure area CA is within an axial base width BA of the flexible rib 230.

The asymmetric friction resistance is related to well known frictional surface contact. Referring to FIG. 4, the shallow flank 235 preferably is facing an insertion direction of the and the steep flank 233 is facing a pull out direction along the insertion axis IA such that the asymmetric friction resistance within the radial contact pressure area CA has a low friction resistance LR in the insertion direction and a high friction resistance HR in the pull out direction. This is due to a self amplifying friction effect in which the undercutting deformed rib portion RU is forced radially away from the axial base width BA in response to a pull out opposing axial friction force FO acting in opposition to the pull out force FP. This in turn increases the contact pressure and the maximum opposing axial friction force FO particular in between the undercutting deformed rib portion RU and the opposing mating face 121, resulting in an increase of the overall friction resistance HR within the contact pressure area CA.

The above described self amplifying friction effect is particularly accomplished by providing firstly a broad axial base with BA relative to the flexible rib height 230H for sufficient radial stiffness, which may be defined by a rib base to height ratio that may be preferably about 2. Secondly, a flank angle difference between the first flank angle 235A and the second flank angle 233A is selected such that during the substantially radial compression substantially only the shallow flank 235 is in contact with the opposite mating face 121. In the preferred embodiment, the flank angle difference is about 65 degrees. Thirdly, the second flank angle 233A is selected such that during the substantially radial compression the steep flank 233 is deformed into an undercutting angle 233U that is preferably about equal a well known friction angle in the radial contact pressure area CA for a predetermined material selection and surface configuration of opposing mating face 121 and shallow flank 235. The second flank angle 233A is preferably about 90 degrees for a standard polished injection mold surface of an injection mold in which the mating face 121 and the shallow flank 235 may be molded from a commercially available material Santoprene™ 203-40.

The opposing mating face 121 and the shallow flank 235 may feature a sealing surface configuration, which may include a high surface smoothness. As a favorable result and during the operational substantially radial compression, the flexible ribs 230 may be in circumferentially continuous one directional sealing contact with the opposing mating face 121. While the connector interface 121, 221, 230 is engaged, an interface cavity 319 adjacent the shallow flank 235 is compressed along the insertion axis IA. Pressurized Fluid such as air in an interface cavity 319 is capable of venting through in between the shallow flank 235 and the opposing mating face 121. To the contrary and while the connector interface 121, 221, 230 is forced to disengage, the interface cavity 319 is expanding and the fluid pressure in the interface cavity 319 may decrease. The pressure difference between decreasing interface cavity 319 pressure and an ambient fluid pressure may result in an excess pressure on the steep flank 233 resulting in a radial expansion of the undercutting deformed rib portion RU similar as described for the asymmetric friction resistance. The radial expansion results in an increased sealing effect particular in between the undercutting deformed rib portion RU and the opposing mating face 121 such that an ambient fluid such as air is substantially hampered to flow back into the interface cavity 319. The pressure difference acts on the entire cross section of the tubular protrusion 220 and the steep flank 233 in combination with the one directional sealing effect and assists in opposing a disengaging movement in the connector interface 121, 221, 230 as may be clear to anyone skilled in the art. Geometric conditions of the flexible ribs 230 for the one directional sealing effect are similar as described for the asymmetric friction resistance.

As depicted in FIGS. 1, 2, the flexible ribs 230 may be monolithically fabricated together with a mating protrusion 220 that provides the mating face 221 in a radially outward facing configuration. Fabricating the flexible ribs 230 in a radially outward facing configuration is preferable especially in case of employed well known injection molding fabrication techniques. Nevertheless, the present invention may include embodiments in which the flexible rib may be fabricated on the mating face 121 in a radially inward facing configuration. The mating face 121 may be part of the mating receptacle 120 of the connector 300.

Moreover, the flexible ribs 230 may be monolithically fabricated together with the entire housing 203 of the connector 100. In the preferred and depicted case of the connector 100 being an electric connector, the housing 203 may also include a well known cable strain relief 205 encompassing an exiting cable 303 of the connector 100. A conductive cable core 307 may be conductively connected to a central contact pin 309 that is aligned with the insertion axis IA. A well known pin spring 315 may also be axially fixed on the central contact pin 309. The central contact pin 309 together with pin spring 315 may fit into a contact sleeve 109 of the connector 300. The contact sleeve 109 in turn may fit into the inside 219 of the mating protrusion 220. Irrespective the preferred configuration of the connector 100 as a single pin electric connector, the scope of the invention may be applied to any other connectors as may be well appreciated by anyone skilled in the art. Such connectors may include but are not limited to multi pin electrical connectors and optical connectors.

To connect connectors 100, 300 via their connector interface 121, 221, 230, the connectors 100, 300 are approached with their respective mating protrusion 220 and mating receptacle 120 axially aligned with respect to the insertion axis IA and moved together such that the mating protrusion 220 is inserted into the mating receptacle 120 and the connector interface 121, 221, 230 engages. As the flexible ribs 230 contact the opposing mating face 121 they become substantially radially compressed. As described above sliding friction and/or fluid flow resistance remain low during engaging of the connector interface 121, 221, 230. During operation when unintentional disengaging forces may act onto the connector interface 121, 221, 230, the high friction resistance HR and/or hampered fluid flow may assist in keeping the connector interface 121, 221, 230 together as well as the connector pin 309 and the connector sleeve 109. During intentional disengaging of the two connectors 100, 300 a disengaging force may be applied that is sufficiently high to overcome the high friction resistance HR and/or the hampered fluid flow and its corresponding vacuum effect of the interface cavity 319.

Accordingly, the scope of the invention described in the Figures and the above Specification is set forth by the following claims and their legal equivalent:

What is claimed is:

1. A connecter having an insertion axis and a mating face, wherein:

a. said connector comprises a housing, a flexible rib extending above said mating face of said housing and wherein said flexible rib is propagating along said mating face in a substantial angle with respect to said insertion axis;

b. said flexible rib comprises a saw tooth cross section including a steep flank and a shallow flank such that during substantially radial compression induced by an opposing mating face said flexible rib provides an asymmetric friction resistance against said opposing mating face along said insertion axis;

c. a substantial portion of a radial contact pressure area is within a radial base area of said flexible rib during said substantial radial compression;

d. said shallow flank comprises a first flank angle with respect to said insertion axis and said steep flank comprises a second flank angle with respect to said insertion axis; and e. a flank angle difference between said first flank angle and said second flank angle is such that during said substantially radial compression substantially only said shallow flank is in pressure contact with an opposite mating face providing said radial compression.

2. The connector of claim 1, wherein said shallow flank is facing in an insertion direction of said connector along said insertion axis and said steep flank is facing in a pull out direction of said connector such that said asymmetric friction resistance comprises a low friction resistance in said insertion direction and high friction resistance in said pull out direction.

3. The connector of claim 1, wherein said at least one of said plurality of flexible ribs has a base to height ratio of about 2.

4. The connector of claim 1, wherein said flank angle difference is about 65 degrees.

5. The connector of claim 1, wherein said flexible rib is monolithically fabricated together with a mating protrusion of said connector, said mating protrusion providing said mating face in a radially outward facing configuration.

6. The connector of claim 1, wherein said flexible rib is provided by a mating receptacle, said mating receptacle providing said mating face in a radially inward facing configuration.

7. The connector of claim 1, wherein said flexible rib is monolithically fabricated together with an entire housing of said connector.

8. The connector of claim 1 being an electrical connector.

9. The connector of claim 1, wherein said flexible rib is perpendicular with respect to said insertion axis and circumferentially continuous on said mating face.

10. The connector of claim 1, wherein said steep flank comprises a second flank angle with respect to said insertion axis such that during said substantially radial compression said steep flank is deformed into an undercutting angle.

11. The connector of claim 10, wherein said second flank angle is about 90 degrees.

12. A connector interface having an insertion axis and two opposing mating faces, said connector interface comprising:

A. a housing and a plurality of flexible ribs extending above at least one of said two opposing mating faces, wherein said at least one of said two opposing mating faces being of said housing and wherein at least one of said plurality of flexible ribs is propagating substantially circumferentially continuous around said at least one of said two opposing mating faces;

B. a saw tooth cross section of the flexible rib that is including a steep flank and a shallow flank; and C. a sealing surface configuration on said shallow flank and one other of said two opposing mating faces such that during a substantially radial compression induced by said one other of said two opposing mating faces onto said at least one of said plurality of flexible ribs a one directional sealing effect is provided in between said flexible rib and said one other of said two opposing mating faces, said one directional sealing effect including a hampered fluid flow from said steep flank across said shallow flank being in radial pressure contact with said one other of said two opposing mating faces.

13. The connector interface of claim 12, further comprising an interface cavity adjacent said shallow flank, said interface cavity being substantially closed while said connector interface is engaged and during said substantially radial compression.

14. The connector interface of claim 12, wherein said shallow flank is facing in an insertion direction of said connector interface along said insertion axis and said steep flank is facing in a pull out direction of said connector interface such that said hampered fluid flow assists in opposing a disengaging movement in said connector interface.

15. The connector interface of claim 12, wherein said flexible rib at least one of said plurality of flexible ribs has a base to height ratio of about 2.

16. A connector interface having an insertion axis and two opposing mating faces, said connector interface comprising:

A. a housing and a flexible rib extending above at least one of said two opposing mating faces, wherein said at least one of said two opposing mating faces is of said housing and is propagating substantially circumferentially continuous around said at least one of said two opposing mating faces;

B. a saw tooth cross section of the flexible rib that is including a steep flank and a shallow flank;

C. a sealing surface configuration on said shallow flank and one other of said two opposing mating faces such that during a substantially radial compression induced by said one other of said two opposing mating faces onto said flexible rib a one directional sealing effect is provided in between said flexible rib and said one other of said two opposing mating faces, said one directional sealing effect including a hampered fluid flow from said steep flank across said shallow flank being in radial pressure contact with said one other of said two opposing mating faces;

wherein said shallow flank comprises a first flank angle with respect to said insertion axis and said steep flank comprises a second flank angle with respect to said insertion axis; and wherein a flank angle difference between said first flank angle and said second flank angle is such that during said substantially radial compression substantially only said shallow flank is in said pressure contact.

17. The connector interface of claim 16, wherein said flank angle difference is about 65 degrees.

18. The connector interface of claim 16, wherein said steep flank comprises a second flank angle with respect to said insertion axis such that during said substantially radial compression said steep flank is deformed into an undercutting angle.

19. The connector interface of claim 18, wherein said second flank angle is about 90 degrees.

* * * * *